US006751996B2

(12) United States Patent
Sausner et al.

(10) Patent No.: US 6,751,996 B2
(45) Date of Patent: Jun. 22, 2004

(54) DYNAMIC PUNCH

(75) Inventors: Andreas Sausner, Frankfurt (DE); Manfred Durst, Walldorf (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/199,387

(22) Filed: Jul. 19, 2002

(65) Prior Publication Data

US 2003/0140676 A1 Jul. 31, 2003

(Under 37 CFR 1.47)

(30) Foreign Application Priority Data

Jul. 20, 2001 (DE) ..... 101 35 515

(51) Int. Cl.[7] ..... B21D 19/08
(52) U.S. Cl. ..... 72/318; 72/316; 72/370.11
(58) Field of Search ..... 72/318, 316, 358, 72/354.6, 354.8, 370.1, 370.11, 370.13, 370.03

(56) References Cited

U.S. PATENT DOCUMENTS

| | | | | | |
|---|---|---|---|---|---|
| 1,505,409 | A | * | 8/1924 | Mueller | 72/318 |
| 2,352,265 | A | * | 6/1944 | Kapple | 72/358 |
| 2,447,909 | A | * | 8/1948 | Hunziker | 72/318 |
| 3,031,007 | A | * | 4/1962 | Temple | 72/318 |
| 3,833,984 | A | * | 9/1974 | Dietzel | 72/370.03 |
| 4,100,781 | A | * | 7/1978 | Zawacki et al. | 72/318 |
| 4,776,196 | A | | 10/1988 | Cudini | 72/316 |
| 4,980,961 | A | * | 1/1991 | Caudill | 72/316 |
| 6,199,421 | B1 | | 3/2001 | Ploeger | |

FOREIGN PATENT DOCUMENTS

| | | | | |
|---|---|---|---|---|
| DE | 344 43 217 | | 6/1885 | |
| EP | 0284773 | | 5/1988 | |
| SU | 586954 | * | 1/1978 | 72/318 |

* cited by examiner

*Primary Examiner*—Daniel C. Crane
(74) *Attorney, Agent, or Firm*—Young & Basile, P.C.

(57) ABSTRACT

A forming tool for pipe ends with a fixing device holding the pipe and a flanging die acting on the projection of the pipe end, where the flanging die has a mandrel which can be driven into the pipe end. A forming die surrounds the mandrel. The mandrel and the forming die are held in a housing. A limiting die surrounding the forming die being provided.

36 Claims, 2 Drawing Sheets

DYNAMIC PUNCH

BACKGROUND

The invention relates to a forming tool for pipe ends with a fixing device holding the pipe and a flanging die acting on the projection of the pipe end, wherein the flanging die has a mandrel driven into the pipe end and a forming die surrounding the mandrel and the mandrel and the forming die are held in a housing.

Forming tools of this type are required to upset or pressure-form pipe ends, i.e., to shape the pipe end. Examples of pipes are primarily hydraulic or pneumatic pipes made of metal, in particular steel or aluminium which are used to carry fluids, in particular, in motor vehicles. These pipes have to be connected in a fluid-tight manner, for which purpose their ends have to be prepared accordingly. The pipe ends are provided with a peripheral bead by plastic shaping, the end face beaded lip directed radially inwardly being formed by the pipe end.

A tool is used for forming as shown, for example, in FIGS. 4 and 5. After the pipe 152 has been fixed in a fixing device 154 in such a manner that the pipe end projects beyond the fixing device 154 by a predetermined amount, this pipe end is plastically formed axially by means of a flanging die 112. In the process, a mandrel 148 is first introduced into the pipe end 150 and subsequently the region of the pipe end 150 located downstream of the end supported by the mandrel 148 is widened by means of a forming die 140. The flanging die 112 is fed axially in the direction of the pipe end 150 until its housing 110 contacts the fixing device 154 or a corresponding stop.

It has been found that owing to the fixing tolerances of the pipe 152, i.e., owing to different projecting amounts of the pipe end 150, a significant number of unusable forming operations are carried out. There is in fact the risk with an excessive projection of a portion of the pipe material being squashed between the housing 110 and the fixing device 154, as shown in FIG. 6. This expelled collar or flash 158 prevents a cap nut from being applied to the pipe end 150.

The object of the invention is therefore to provide a forming tool for pipe ends with which the pipe end can be produced more precisely even if the pipe projection beyond the fixing device has different values.

SUMMARY

This object is achieved according to the invention with a forming tool of the type mentioned above in that a flanging die limiting the forming die is provided.

The limiting die provided in the forming tool according to the invention provides the fundamental advantage that the end of the pipe projecting beyond the fixing device is completely enclosed prior to forming so this end can be widened to the maximum during forming until it contacts the limiting die. Consequently the formation of a collar or flash which would prevent slipping-on of the cap nut is avoided.

The limiting die advantageously forms the leading end face of the forming tool facing the pipe end. During the forming process, the free pipe end is therefore completely surrounded by the limiting die and the limiting die contacts the fixing device and thus closes the forming space. In the process the limiting die projects beyond the housing axially in the direction of the pipe end.

In one embodiment, the limiting die is resiliently mounted in the axial direction via a spring. This means that during forming the limiting die is driven into the housing so it does not represent an obstacle to the housing approaching the fixing device. The limiting die is guided in an axial aperture of the housing here. The limiting die is advantageously sleeve-shaped.

In a further embodiment, the fixing device has a receptacle for the limiting die which driven into the fixing device at least during forming, so it does not hinder the axial advance of the housing in the direction of the fixing device.

The limiting die is a sleeve-shaped with, in particular, a circular internal cross-section. This internal cross-section limits the external cross-section or forms this external cross-section of the end bead. A shape different from a circle can also be impressed on this end bead.

In one development, the limiting die forms an axial bearing for the forming die so the forming die is guided axially displaceably in the limiting die. The limiting die in its turn is guided in an axial aperture of the housing. Consequently the pipe material is prevented from being driven between the limiting die and the forming die during forming.

In a preferred variation, the forming die is mounted axially displaceably on the mandrel. A separate axial bearing for the radially inner support of the forming die is dispensed with owing to this measure. Simple central lubrication for the forming die and the limiting die is also possible.

To limit the forming force, the forming die can be driven axially into the housing counter to the force of a spring. Both the spring for the forming die and the spring for the limiting die can be designed as mechanical, magnetic, hydraulic or pneumatic springs. The springs are supported here on the housing and, in particular, can be adjusted.

Simple assembly of the flanging die according to the invention is achieved in that the housing has a three-stage aperture and all components can be inserted into the housing from the end remote from the pipe end. Maintenance and repair work is also facilitated hereby. In addition, additional bearing elements are dispensed with as the individual components are nested and mutually supported.

Relatively simple access to the individual components is achieved in that the end of the housing remote from the pipe end has a screw cap. If one and/or the other spring is supported on the screw cap, the spring force can also be adjusted thereby. This can of course also be changed by changing the fluid pressure or by exchanging the springs used.

BRIEF DESCRIPTION OF THE DRAWING

Further advantages, features and details of the invention emerge from the description hereinafter in which a particularly preferred embodiment is described in detail with reference to the drawings. Here the features illustrated in the drawings and in the claims and described in the description can each be essential to the invention alone or in any combination.

In the drawings.

DETAILED DESCRIPTION

Figure 1:
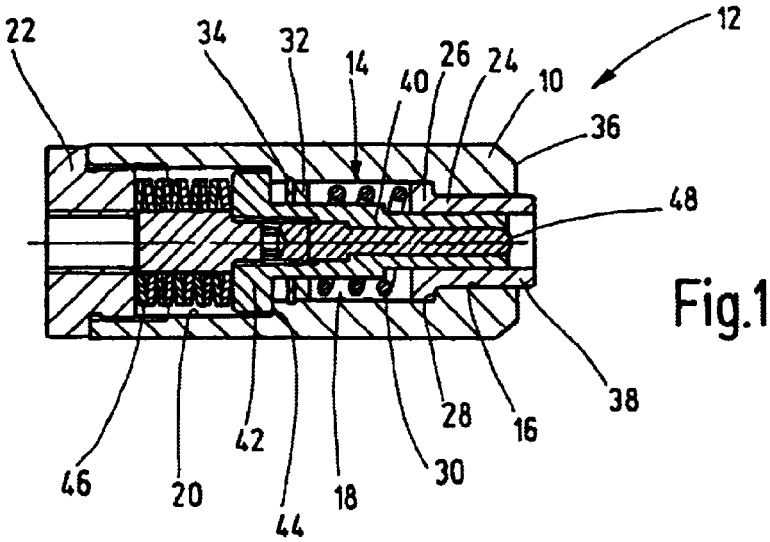
FIG. 1 is a longitudinal section through the flanging die according to the invention depicted in the rest position.
Figure 2:
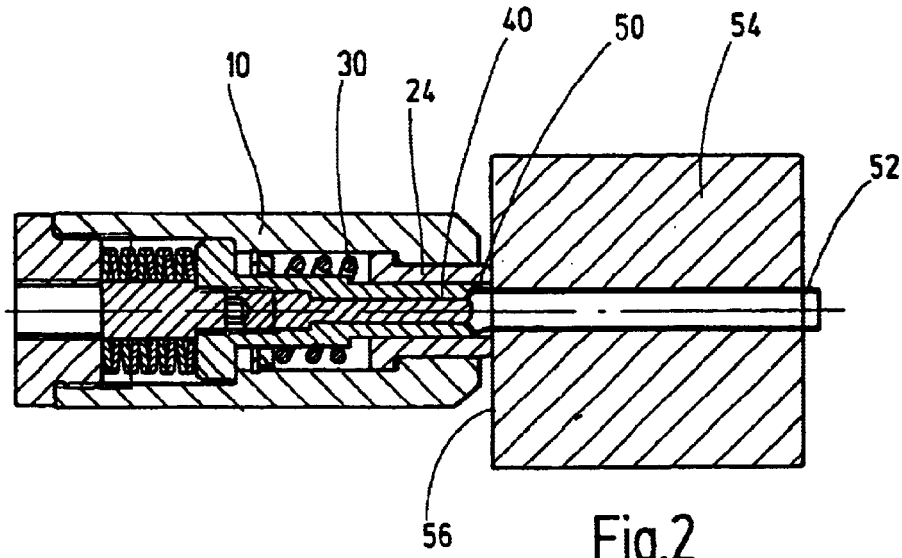
FIG. 2 is a longitudinal section through the forming tool with flanging die applied to the fixing device and a partially formed pipe end.

In the embodiment shown in FIG. 1, a housing of a flanging die designated as a whole by 12 is designated by the reference numeral 10. This flanging die 12 has a three-stage through-aperture 14 with a small diameter 16, a medium diameter 18 and a large diameter 20. The free end of the through-aperture 14 with the large diameter 20 is closed by a screw stopper 22.

A hat-shaped limiting die 24 is inserted axially displaceably into the through-aperture 14 with a small diameter 16. A shoulder 26 projecting radially outwards and forming the inner end of the limiting die 24 engages behind the step 28 of medium diameter 18 to the small diameter 16 of the through-aperture 14. The limiting die 24 is thus prevented from falling out of the housing 10. The shoulder 26 is in turn supported on a helical compression spring 30, the other end of which is held by a support disc 32 and a securing ring 34. The spring 30 is therefore supported on the housing 10 and allows axial insertion of the limiting die 24. In a rest position this limiting die 24 projects beyond the free end 36 of the housing 10 by a projection 38.

The sleeve-like limiting die 24 serves as an axial bearing for a forming die 40, which also has a hat-shaped and sleeve-like configuration. The shoulder 42 engages behind a step 44 of large diameter 20 to the medium diameter 18 and is supported on a spring washer assembly 46 adjoining the screw stopper 22. This permits axial insertion of the forming die 40.

Figure 3:
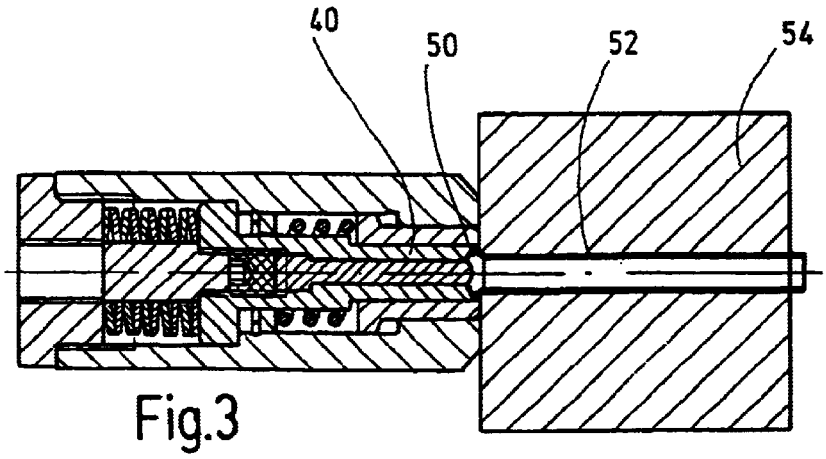
FIG. 3 is a longitudinal section as in FIG. 2 with a completely formed pipe end.
Figure 4:
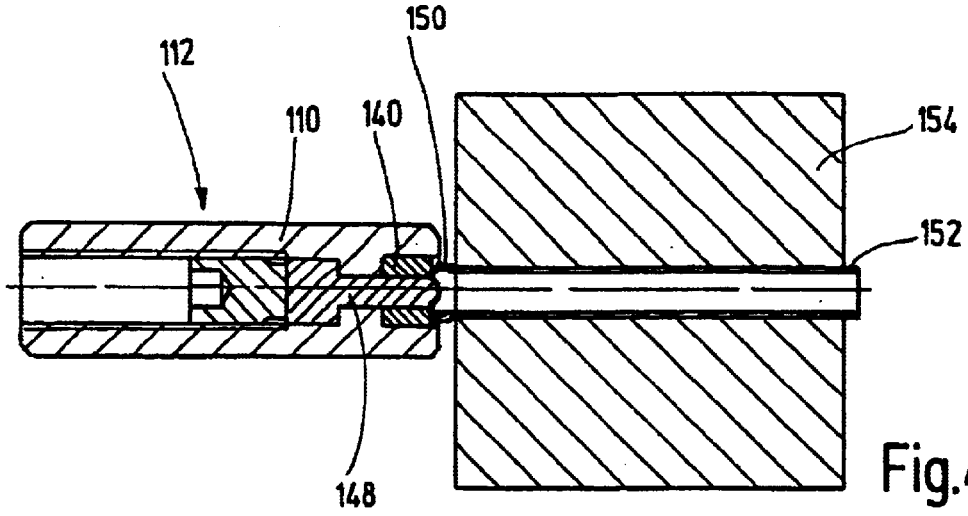
Fig.4 PRIOR ART
FIG. 4 is a longitudinal section through a forming tool according to the prior art with a partially formed pipe end.
Figure 5:
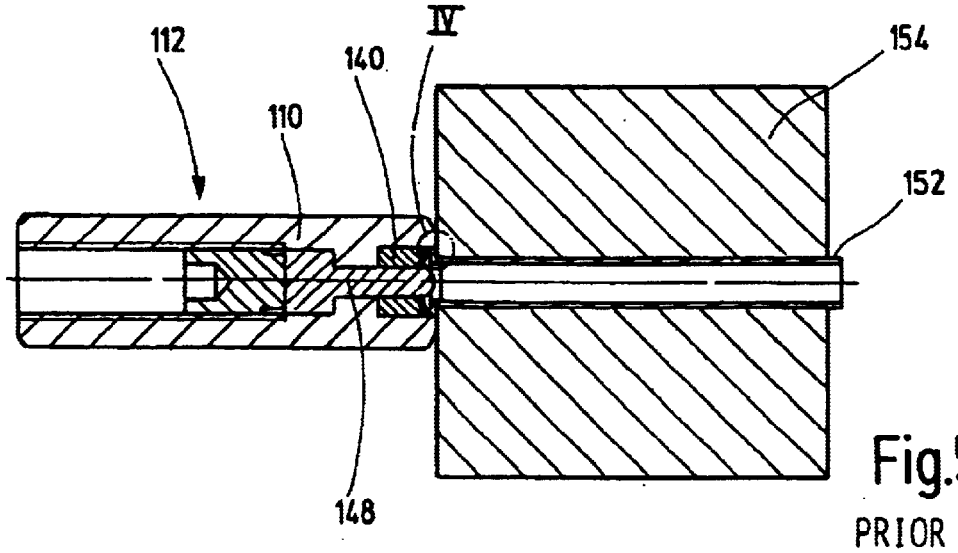
Fig.5 PRIOR ART
FIG. 5 is a longitudinal section through a forming tool according to the prior art with a completely formed pipe end.
Figure 6:
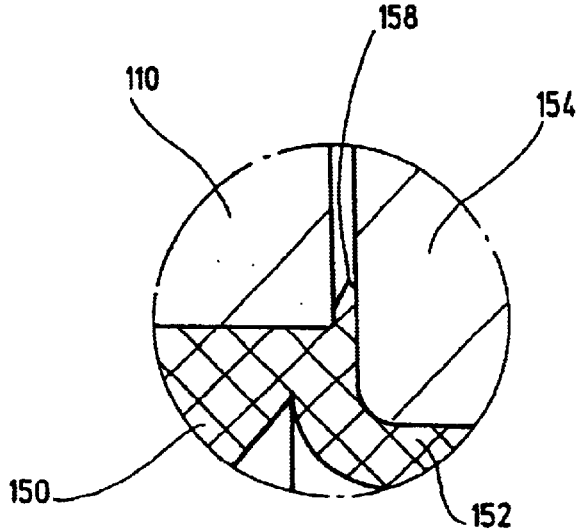
Fig.6 PRIOR ART
FIG. 6 is an enlarged reproduction of the detail VI of FIG. 5.

The sleeve-like forming die 40 receives a mandrel 48 which secured to the housing and of which the external diameter determines the final internal diameter of the free end 50 of a formed pipe 52, as shown in FIG. 3.

The mode of operation of the flanging die 12 will be described hereinafter. The flanging die 12 is moved in the direction of the free end 50 of the pipe 52 in such a way that the mandrel 48 enters this free end 50. In the process the pipe 52 is held by a fixing device 54. In addition, the free end of the projection 38 of the limiting die 24 contacts the end face 56 of the fixing device 54. This can occur before or shortly after forming of the pipe end 50 begins. The pipe end 50 is therefore completely enclosed.

If the housing 10 is moved further in the direction of the fixing device 54, the limiting die 24 moves into the housing 10 counter to the force of the spring 30. In addition, the free end 50 of the pipe 52 is formed in a conventional manner by means of the forming die 40.

To avoid damage to the flanging die 12 or the fully formed end 50 of the pipe 52 after forming, the forming die 40 is also mounted axially displaceably so it can avoid an accumulation of material in the forming region. This is the case, for example, if the projection of the free end 50 of the pipe 52 is too large as a result of tolerances.

A collar or flash 158 cannot form on the free end 50 of the pipe 52 as the free end 50 is always surrounded by the housing 10, even during the forming process in which the limiting die 24 moves into the housing 10.

What is claimed is:

1. A forming tool for pipe ends with a fixing device holding the pipe and a flanging die acting on a projection of the pipe end, wherein the flanging die has a mandrel which can be driven into the pipe end and a forming die surrounding the mandrel, the mandrel and the forming die being held in a housing, characterized in that a limiting die surrounds the forming die, the limiting die being resiliently mounted in the axial direction by a spring.

2. The forming tool according to claim 1, characterized in that the limiting die forms a leading end face of the flanging die facing the pipe end.

3. The forming tool according to claim 1, characterized in that the limiting die projects beyond the housing axially in the direction of the pipe end.

4. The forming tool according to claim 1, characterized in that the limiting die has a sleeve-like shape.

5. The forming tool according to claim 1, characterized in that the forming die is axially displaceably mounted on the mandrel.

6. The forming tool according to claim 1, characterized in that the spring is one of a mechanical, a magnetic, a hydraulic and a pneumatic spring.

7. The forming tool according to claim 1, characterized in that the spring is supported on the housing.

8. The forming tool according to claim 1, characterized in that the housing has a three-stage aperture and all components can be inserted into the housing from an end remote from the pipe end.

9. The forming tool according to claim 1, characterized in that an end of the housing remote from the pipe end has a screw cap.

10. The forming tool according to claim 1, characterized in that pressure force of the forming die can be adjusted from an end of the housing remote from the pipe end.

11. A forming tool for pipe ends with a fixing device holding the pipe and a flanging die acting on a projection of the pipe end, wherein the flanging die has a mandrel which can be driven into the pipe end and a forming die surrounding the mandrel, the mandrel and the forming die being held in housing, characterized in that a limiting die surrounds the forming die, and the limiting die is guided in an axial aperture of the housing.

12. The forming tool according to claim 11, characterized in that the limiting die forms a leading end face of the flanging die facing the pipe end.

13. The forming tool according to claim 11, characterized in that the limiting die projects beyond the housing axially in the direction of the pipe end.

14. The forming tool according to claim 11, characterized in that the limiting die has a sleeve-like shape.

15. The forming tool according to claim 11, characterized in that the forming die is axially displaceably mounted on the mandrel.

16. The forming tool according to claim 11, characterized in that the housing has a three-stage aperture and all components can be inserted into the housing from an end remote from the pipe end.

17. The forming tool according to claim 11, characterized in that an end of the housing remote from the pipe end has a screw cap.

18. The forming tool according to claim 11, characterized in that pressure force of the forming die can be adjusted from an end of the housing remote from the pipe end.

19. A forming tool for pipe ends with a fixing device holding the pipe and a flanging die acting on a projection of the pipe end, wherein the flanging die has a mandrel which can be driven into the pipe end and a forming die surrounding the mandrel, the mandrel and the forming die being held in a housing, characterized in that a limiting die surrounds the forming die, and the forming die is axially displaceably guided in the limiting die.

20. The forming tool according to claim 19, characterized in that the limiting die forms a leading end face of the flanging die facing the pip end.

21. The forming tool according to claim 19, characterized in that the limiting die projects beyond the housing axially in the direction of the pipe end.

22. The forming tool according to claim 19, characterized in that the limiting die has a sleeve-like shape.

23. The forming tool according to in claim 19, characterized that the forming die is axially displaceably mounted on the mandrel.

24. The forming tool according to claim 19, characterized in that the housing has a three-stage aperture and all components can be inserted into the housing from an end remote from the pipe end.

25. The forming tool according to claim 19, characterized in that the end of the housing remote from the pipe end has a screw cap.

26. The forming tool according to claim 19, characterized in that pressure force of the forming die can be adjusted from an end of the housing remote from the pipe end.

27. A forming tool for pipe ends with a fixing device holding the pipe and a flanging die acting on a projection of the pipe end, wherein the flanging die has a mandrel which can be driven into the pipe end and a forming die surrounding the mandrel, the mandrel and the forming die being held in a housing characterized in that a limiting die surrounds the forming die, and the forming die is driven axially into the housing counter to the pressure of a spring.

28. The forming tool according to claim 27, characterized in that the spring is one of a mechanical, a magnetic, a hydraulic and a pneumatic spring.

29. The forming tool according to claim 27, characterized in that the limiting die forms a leading end face of the flanging die facing the pipe end.

30. The forming tool according to claim 27, characterized in that the limiting die projects beyond the housing axially in the direction of the pipe end.

31. The forming tool according to claim 27, characterized in that the limiting die has a sleeve-like shape.

32. The forming tool according to claim 27, characterized that the forming die is axially displaceably mounted on the mandrel.

33. The forming tool according to claim 27, characterized in that the spring is on the housing.

34. The forming tool according to claim 27, characterized in that the housing has a three-stage aperture and all components can be inserted into the housing from an end remote from the pipe end.

35. The forming tool according to claim 27, characterized in that an from the pipe end has a screw cap.

36. The forming tool according to claim 27, characterized in that pressure force of the forming die can be adjusted from an end of the housing remote from the pipe end.

* * * * *